US010745945B2

(12) United States Patent
Balakrishna et al.

(10) Patent No.: US 10,745,945 B2
(45) Date of Patent: Aug. 18, 2020

(54) LINKAGE SYSTEM FOR VEHICLE DOOR LATCH

(71) Applicant: Inteva Products, LLC, Troy, MI (US)

(72) Inventors: Abhishek Hubli Balakrishna, Bangalore (IN); Arun Manjunath, Mysore (IN); Vinayak Giriyalkar, Belgaum (IN); Randhir Pillai, Bangalore (IN)

(73) Assignee: INVEVA PRODUCTS, LLC, Troy, MI (US)

( * ) Notice: Subject to any disclaimer, the term of this patent is extended or adjusted under 35 U.S.C. 154(b) by 72 days.

(21) Appl. No.: 14/979,487

(22) Filed: Dec. 27, 2015

(65) Prior Publication Data

US 2016/0186458 A1 Jun. 30, 2016

(30) Foreign Application Priority Data

Dec. 27, 2014 (IN) ..... 3944/DEL/2014

(51) Int. Cl.
*E05B 79/20* (2014.01)
*E05B 85/08* (2014.01)
*E05B 79/22* (2014.01)

(52) U.S. Cl.
CPC ..... *E05B 79/20* (2013.01); *E05B 79/22* (2013.01); *E05B 85/08* (2013.01); *Y10T 292/1047* (2015.04); *Y10T 292/1082* (2015.04); *Y10T 292/1092* (2015.04); *Y10T 292/57* (2015.04)

(58) Field of Classification Search
CPC ..... E05B 79/20; E05B 79/22; E05B 85/08; Y10T 292/1092; Y10T 292/1082; Y10T 292/1047; Y10T 292/57
USPC ..... 292/336.3, 210, 201, 216
See application file for complete search history.

(56) References Cited

U.S. PATENT DOCUMENTS 1,395,477 A * 11/1921 Budd ..... E05B 85/22 292/173
1,530,341 A * 3/1925 Bannochie ..... E05B 63/24 292/198
2,834,628 A * 5/1958 Paparelli ..... E05B 85/08 292/347
4,083,589 A * 4/1978 Palmerino ..... E05B 85/08 292/336.3

(Continued)

FOREIGN PATENT DOCUMENTS

CN 201933936 U 8/2011
CN 203403738 U * 1/2014

(Continued)

OTHER PUBLICATIONS

CN Office Action dated Jan. 12, 2018 for Application No. 201510994477.0.

(Continued)

*Primary Examiner* — Kristina R Fulton
*Assistant Examiner* — Faria F Ahmad
(74) *Attorney, Agent, or Firm* — Cantor Colburn LLP

(57) ABSTRACT

A linkage system for vehicle door latch is provided. The system having: a sill button; a latch; a cable operatively coupled to the latch and the sill button; and a sill button interface directly secured to an end of the cable at one end and the sill button at another end, wherein the cable extends directly from the sill button interface to the latch.

19 Claims, 6 Drawing Sheets

(56) References Cited

U.S. PATENT DOCUMENTS

| | | | | | |
|---|---|---|---|---|---|
| 4,238,133 | A * | 12/1980 | Trammell, Jr. | E05B 85/08 | 292/336.3 |
| 4,266,816 | A * | 5/1981 | Mukai | E05B 79/20 | 292/125 |
| 4,290,634 | A * | 9/1981 | Gelhard | E05B 81/25 | 292/201 |
| 4,415,192 | A * | 11/1983 | Kodama | E05B 85/08 | 292/1 |
| 4,674,780 | A * | 6/1987 | Weinerman | E05B 85/08 | 292/1 |
| 4,674,781 | A * | 6/1987 | Reece | E05B 81/25 | 292/201 |
| 4,793,640 | A * | 12/1988 | Stewart, Sr. | E05B 81/25 | 292/199 |
| 4,858,971 | A * | 8/1989 | Haag | E05B 77/48 | 292/201 |
| 4,876,143 | A * | 10/1989 | Sugita | B29C 70/088 | 428/298.4 |
| 5,117,665 | A | 6/1992 | Swan et al. | | |
| 5,676,003 | A * | 10/1997 | Ursel | E05B 77/26 | 292/201 |
| 5,722,272 | A | 3/1998 | Bridgeman et al. | | |
| 5,794,995 | A * | 8/1998 | Creesy | E05B 85/08 | 292/348 |
| 6,390,708 | B1 * | 5/2002 | Gueret | A45D 34/045 | 15/207.2 |
| 6,880,866 | B2 * | 4/2005 | Tomaszewski | E05B 77/26 | 292/201 |
| 7,204,529 | B2 * | 4/2007 | Barlow, Jr. | E05B 85/08 | 292/336.3 |
| 7,827,836 | B2 * | 11/2010 | Cetnar | E05B 77/28 | 70/257 |
| 8,794,863 | B2 * | 8/2014 | Hohmann | E05B 85/08 | 403/322.4 |
| 9,309,835 | B2 * | 4/2016 | Ko | F02K 1/763 | |
| 2005/0073158 | A1 * | 4/2005 | Zingelmann | E05B 85/08 | 292/336.3 |
| 2009/0064591 | A1 * | 3/2009 | Keller | B60J 5/00 | 49/358 |
| 2013/0221689 | A1 * | 8/2013 | Kreuz | E05B 85/08 | 292/336.3 |
| 2016/0123044 | A1 * | 5/2016 | Rosales | E05B 79/20 | 74/502.6 |
| 2016/0168884 | A1 * | 6/2016 | Hillgaertner | E05B 79/20 | 292/196 |
| 2017/0114568 | A1 * | 4/2017 | Bauer | E05B 41/00 | |

FOREIGN PATENT DOCUMENTS

| | | | |
|---|---|---|---|
| CN | 203403738 | U | 1/2014 |
| CN | 203846893 | U | 9/2014 |
| CN | 204457176 | U | 7/2015 |
| CN | 205778034 | U | 12/2016 |
| EP | 0738363 | | 10/1996 |

OTHER PUBLICATIONS

CN Search Report dated Jan. 12, 2018 for Application No. 201510994477.0.

English Translation for Abstract CN201933936 (U).

English Translation for Abstract CN203846893 (U).

English Translation for Abstract CN204457176 (U).

English Translation of CN Office Action dated Jan. 12, 2018 for Application No. 201510994477.0.

CN Office Action dated Mar. 21, 2019 for Application No. 201510994477.0.

English Machine Translation to CN Office Action dated Mar. 21, 2019 for Application No. 201510994477.0.

CN Office Action for Application No. 201510994477.0; dated Oct. 14, 2019.

English Translation to CN Office Action for Application No. 201510994477.0; dated Oct. 14, 2019.

First Examination Report for Indian Patent Application No. 3944/DEL/2014.

* cited by examiner

LINKAGE SYSTEM FOR VEHICLE DOOR LATCH

CROSS REFERENCE TO RELATED APPLICATIONS

This application claims priority under 35 U.S.C. § 119 to the following Indian Patent Application Ser. No. 3944/DEL/2014, filed on Dec. 27, 2014, the entire contents of which are incorporated herein by reference thereto.

BACKGROUND

Various embodiments of the present invention relate generally to latch mechanisms and, more particularly, an integrated rod feature for a sill button interface to a cable of a vehicle latch.

Conventional latch mechanisms may include multiple items, each coupled to a lever or other component of the latch for carrying out various functions, such as locking and/or releasing the latch for example. The current state of art for latching systems with a sill button feature on a vehicle is to have rod linkages attached to the sill button to achieve inside locking and unlocking as the sill button is moved up and down.

In addition and in some configurations there is a rocker arm mechanism that is used to reverse the lock/unlock direction, which in turn results in an inefficient system leading to stroke loss and higher efforts due to more mechanical components. The problem faced by having systems with a rigid sill rod and/or a rocker arm mechanism or bell crank mechanism is that due to certain packaging constraints these systems are not particularly suited for certain vehicle door configurations. Accordingly, it is desirable to eliminate the rigid sill rod on front door latch systems as well as also eliminate the bell crank mechanism and/or rigid sill rods in rear door latch systems in order to allow for ease of assembly.

Accordingly, it is desirable to provide an improved linkage system for operatively coupling a sill button to the latch wherein rigid sill rods and/or bell crank or rocker mechanisms are eliminated.

SUMMARY OF THE INVENTION

According to an embodiment of the present invention, a linkage system for vehicle door latch is provided. The system having: a sill button; a latch; a cable operatively coupled to the latch and the sill button; and a sill button interface directly secured to an end of the cable at one end and the sill button at another end, wherein the cable extends directly from the sill button interface to the latch.

According to another embodiment of the present invention, a vehicle door latch is provided. The vehicle door latch having: a sill button; a latch; a cable operatively coupled to the latch and the sill button; and a sill button interface directly secured to an end of the cable at one end and the sill button at another end, wherein the cable extends directly from the sill button interface to the latch.

According to yet another embodiment, a method of operatively coupling a sill button to a vehicle latch is provided. The method including the steps of: securing a first end of a cable to the sill button with a sill button interface; securing a second end of the cable to the latch; and wherein the cable extends directly from the sill button interface to the latch.

The above-described and other features and advantages of the present invention will be appreciated and understood by those skilled in the art from the following detailed description, drawings, and appended claims.

BRIEF DESCRIPTION OF THE DRAWINGS

Embodiments of the present invention will now be described, by way of example only, with reference to the accompanying drawings in which.

DETAILED DESCRIPTION

In accordance with various embodiments of the present invention a latch to sill button linkage system comprising only a cable is provided.

Figure 1:
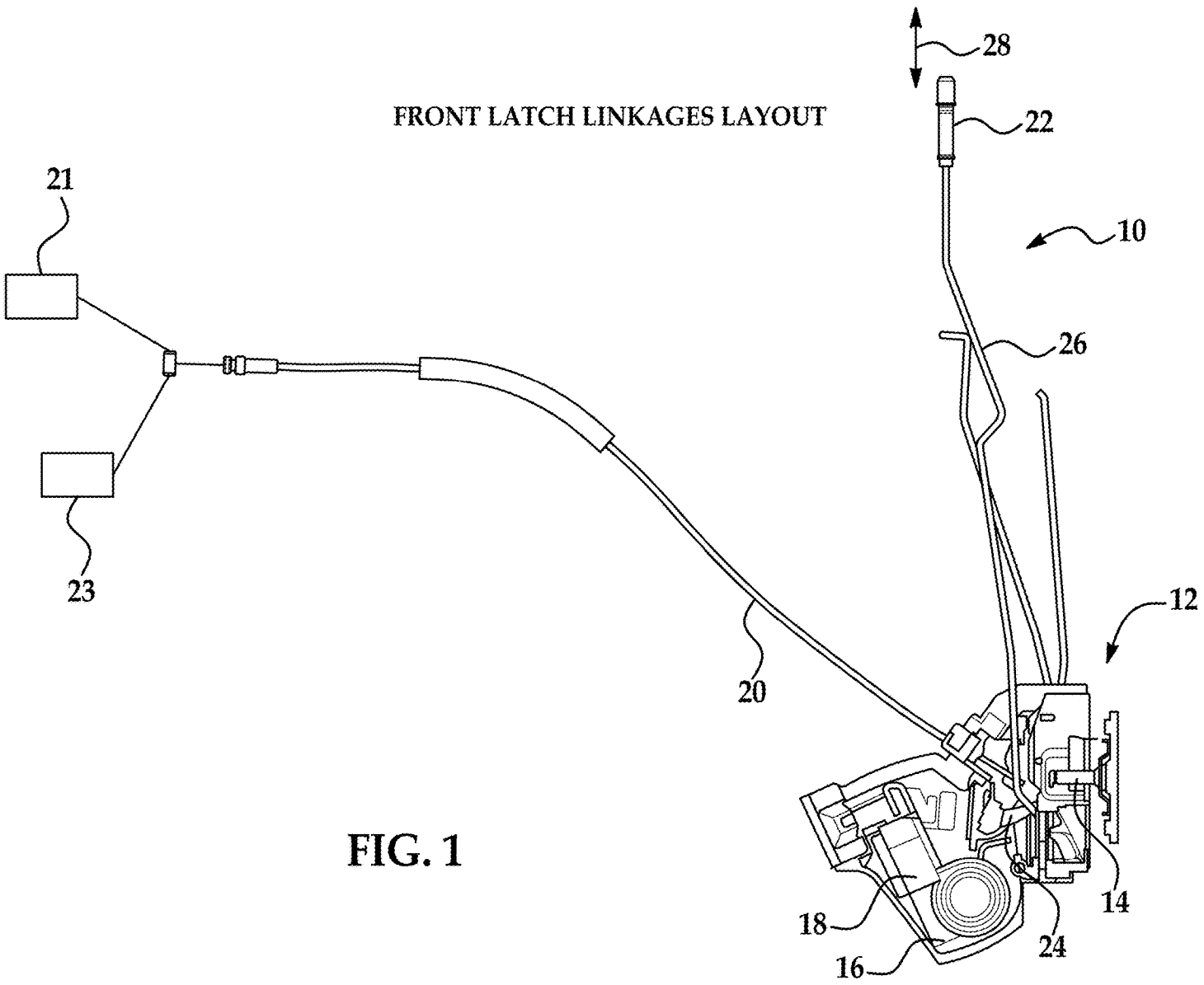
FIG. 1 is an illustration of a front door vehicle latch linkage system.

Referring now to FIG. 1 a front door vehicle latch linkage system 10 is illustrated. Here a latch 12 configured to releasably secure and release a striker 14 of the vehicle is illustrated. Latch 12 may also comprise an actuator 16 with the motor 18 that is configured to manipulate components of the latch 12 in accordance with known technologies. Also shown in FIG. 1 is a release cable 20 that is configured to manipulate a lever and ultimately a detent lever or pawl or fork bolt or claw of the latch 12 such that upon actuation of the release cable the striker releaseably secured by the fork bolt or claw is released therefrom. For example, release cable 20 may be operably coupled to an inside release lever 21 or an outside release lever 23 (each being illustrated schematically by boxes in FIG. 1), which when manipulated by an operator or passenger or system of the vehicle moves cable 20 and ultimately a component of the latch 12.

A sill button 22 is operatively coupled to a lever 24 of the latch via a sill rod 26. The sill button 22 may be positioned in a convenient location on an interior surface of the vehicle door such that an operator or passenger of the vehicle may manipulate the sill button 22 up and down so that the latch 12 can transition between a locked state and unlocked state. For example, sill button 22 may be located on an interior surface of the vehicle door so that an operator or passenger of the vehicle may manipulate the same in order to lock and unlock the latch 12. Accordingly and as sill button 22 is moved upwardly and downwardly in the direction of arrows 28, the sill rod 26 manipulates lever 24 such that the latch 12 transitions between the locked state and the unlocked state due to the movement of sill button 22 in the direction of arrows 28.

Figure 2A:
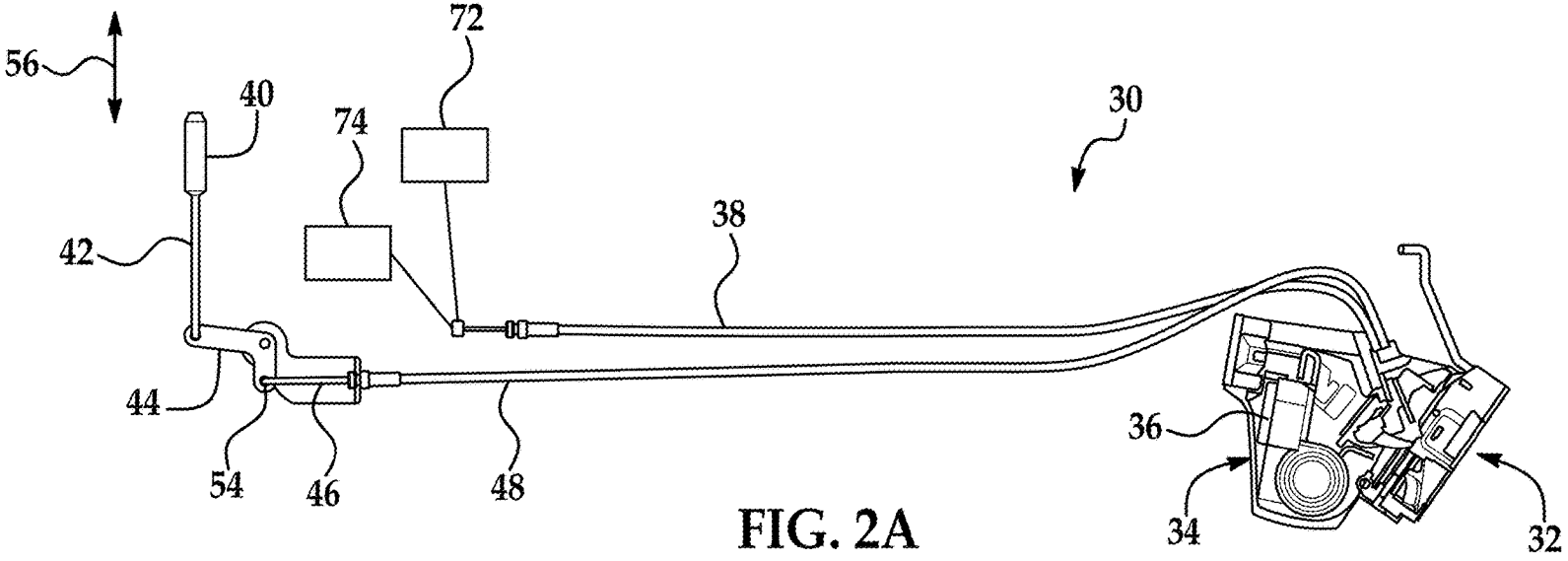
FIGS. 2A and 2B are views of a rear door vehicle latch linkage system.
Figure 2B:
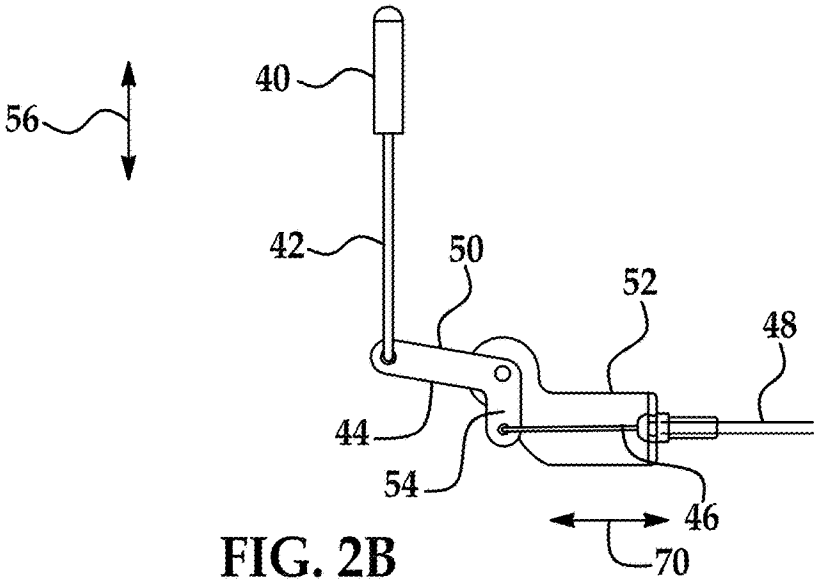

Referring now to FIGS. 2A and 2B, a rear door vehicle latch linkage system 30 is illustrated. Here a rear latch 32 is configured to releasably secure and release a striker (not shown) of the vehicle. Similar to the latch 12 of the front door system 10, the latch 32 may also comprise an actuator 34 with a motor 36 that is configured to manipulate components of the latch 32 in accordance with known technologies. Also shown in FIG. 2A is a release cable 38, which similar to the front door vehicle latch system, is configured to manipulate a lever and ultimately a detent lever or claw or fork bolt or claw of the latch 32 in order to allow the latch 32 to release a striker and thus allow the vehicle door to be opened. For example, release cable 38 may be operably coupled to an inside release lever 72 or an outside release lever 74 (each being illustrated schematically by boxes in FIGS. 2A and 2B), which when manipulated an operator or passenger or system of the vehicle moves cable 38 and ultimately a component of the latch 32.

A sill button 40 is operatively coupled to a lever of the latch via a sill rod 42, a bell crank or bell crank lever 44 and a sill cable 46 that is slidably received within a cable sheath 48. In this system, the sill rod 42 is secured to the sill button 40 at one end while an opposite end of the sill rod 42 is secured to a first arm member 50 of the bell crank or bell crank lever 44 that is pivotally mounted to a sill cable mounting bracket 52 and a second arm 54 of the bell crank or bell crank lever 44 is operatively coupled to one end of the sill cable 46. In this system and in order to transition the latch 32 between a locked and unlocked state, the sill button 40 is moved up and down in the directions of arrows 56. As such, the movement of the sill button 40 in the directions of arrows 56 will cause a corresponding movement of the sill rod 42 in the directions of arrows 56. Since one end of the sill rod 42 is also pivotally secured to the first arm member 50 of the bell crank or bell crank lever 44 movement of the sill rod 42 in the directions of arrows 56 will cause a corresponding rotational movement of the bell crank or bell crank lever 44 in the directions of arrows 58. This corresponding rotational or pivotal movement of the bell crank or bell crank lever 44 in the directions of arrows 58 will cause movement of the sill cable 46 in the directions of arrows 70 since the second arm member 54 of the bell crank or bell crank lever 44 is also pivotally secured to the sill cable 46.

The system 30 requires the use of a bell crank or bell crank lever 44 in order to transition vertical movement of the sill button 40 into horizontal movement of the sill cable 46. This requires additional components and may make the system susceptible to stroke loss or higher efforts to move the sill button 40 in the desired directions.

As mentioned above, the systems 10 and 30 require the use of multiple components, which limit operational configurations of the systems since the use of a rigid sill rod requires either the use of a rocker arm mechanism (e.g., rear door vehicle latch systems) to reverse the lock/unlock direction, which in turn results in an inefficient system leading to stroke loss and higher efforts due to more mechanical components or a longer sill rod (e.g., front door vehicle latch systems) in order to transition the larger vertical distance from the sill button to the latch in the front door vehicle latch system. Some problems associated with these systems is that due to certain packaging requirements it is undesirable to use rigid sill rods and still further longer rigid sill rods (e.g., front door latch systems) as well as bell crank mechanisms (e.g., rear door latch systems). In other words, some vehicle door configurations have limited real estate for inclusion and securement of the required vehicle door latch system thus, the vehicle door latch system needs to be installed into a vehicle door latch that may have a limited amount of space and/or passageways between the sill button and the latch.

To overcome the above mentioned constraints and to provide for ease of assembly of either a front door vehicle latch system or a rear door vehicle latch system various embodiments of the present invention are directed to an integrated linkage system that transfers movement of the sill button to the latch with only a single cable. In accordance with some embodiments of the present invention the single cable is attached to the latch at one end while the other end of the cable has a crimped threaded rod feature that is directly assembled to the sill button. This design will eliminate the need for a rocker arm mechanism used to convert the direction of motion of the sill button and will provide for better packaging flexibility since the sill button can be easily relocated without having to redesign or move a rocker arm mechanism such as the aforementioned bell crank or bell crank lever 44.

Furthermore, using only a single cable further aids in achieving comparatively lower efforts, better feel and flexibility of the system. Still further, the usage of a single cable has inherent advantages over rigid sill rods as their inherent flexibility makes them less likely to be damaged or distorted (e.g., manipulation or bending of the cable will not adversely affect operation of the system) such that operation of the latch system would be compromised. Sill rods on the other hand are rigid and typically are not flexible and thus may create excessive friction during operation of the system should be the sill rod be inadvertently deformed after it has been installed in the vehicle or alternatively when it is being installed in the vehicle.

Figure 3:
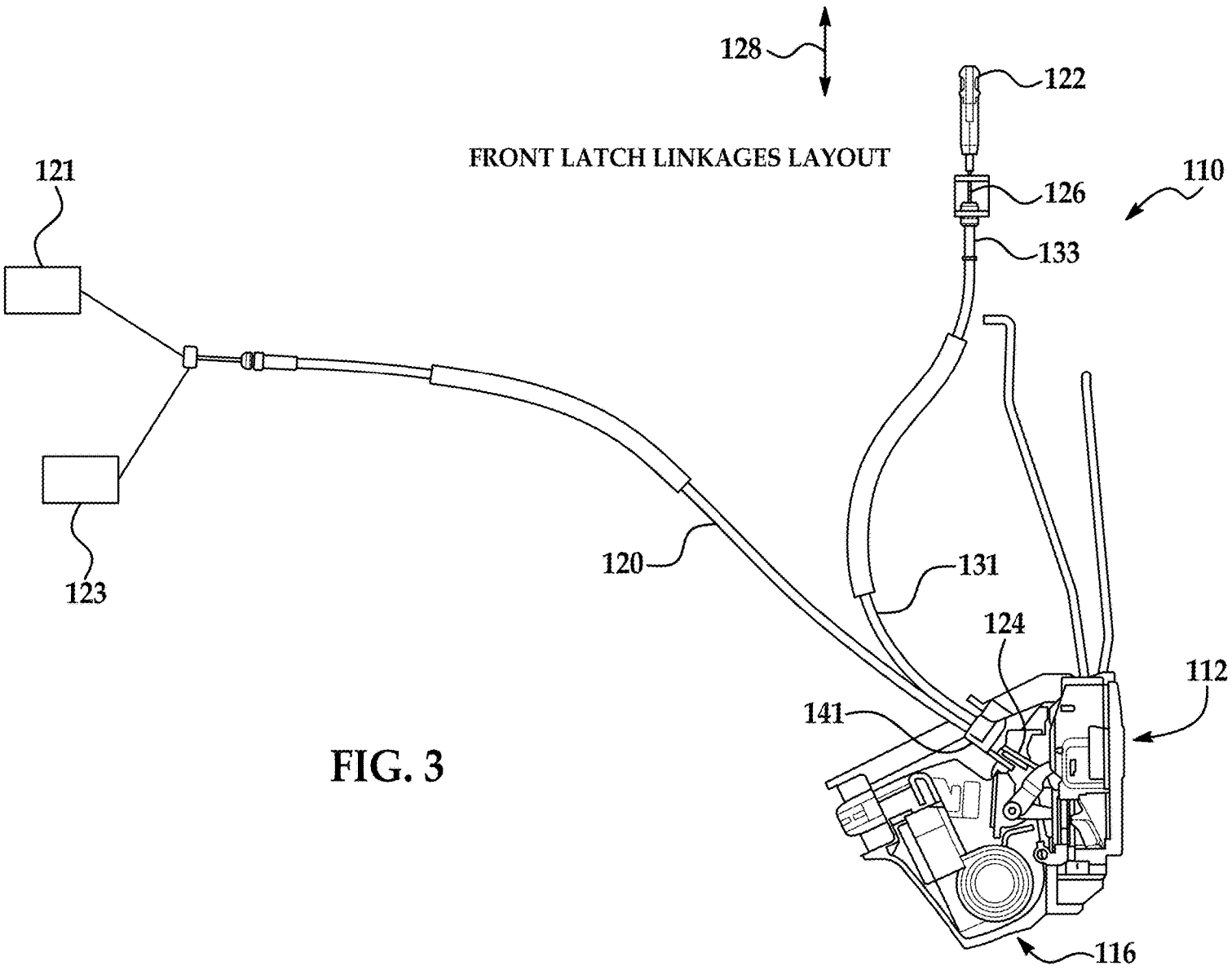
FIG. 3 is an illustration of a front door vehicle latch linkage system in accordance with an embodiment of the present invention.

Referring now to FIG. 3, a front door vehicle latch linkage system 110 in accordance with an embodiment of the present invention is illustrated. Here a latch 112 is configured to releasably secure and release a striker (not shown) of the vehicle. Latch 112 may also comprise an actuator 116 with a motor that is configured to manipulate components of the latch 112 in accordance with known technologies. The system 110 may also comprise a release cable 120 that is configured to manipulate a lever and ultimately a detent lever or claw and/or fork bolt or claw of the latch 112 so that a striker releasably retained by the fork bolt or claw of the latch 112 is released therefrom due to manipulation of the release cable 120. For example, release cable 120 may be operably coupled to an inside release lever 121 or an outside release lever 123 (each being illustrated schematically by boxes in FIG. 3), which when manipulated an operator or passenger or system of the vehicle moves cable 120 and ultimately a component of the latch 112.

Here a sill button 122 is operatively coupled to a lever 124 of the latch 112 via a single sill cable 126. Accordingly and as sill button 122 is moved upwardly and downwardly in the direction of arrows 128, the sill cable 126 manipulates lever 124 such that the latch 112 transitions between a locked and unlocked state due to the movement of sill button 122 in the direction of arrows 128.

Figure 4:
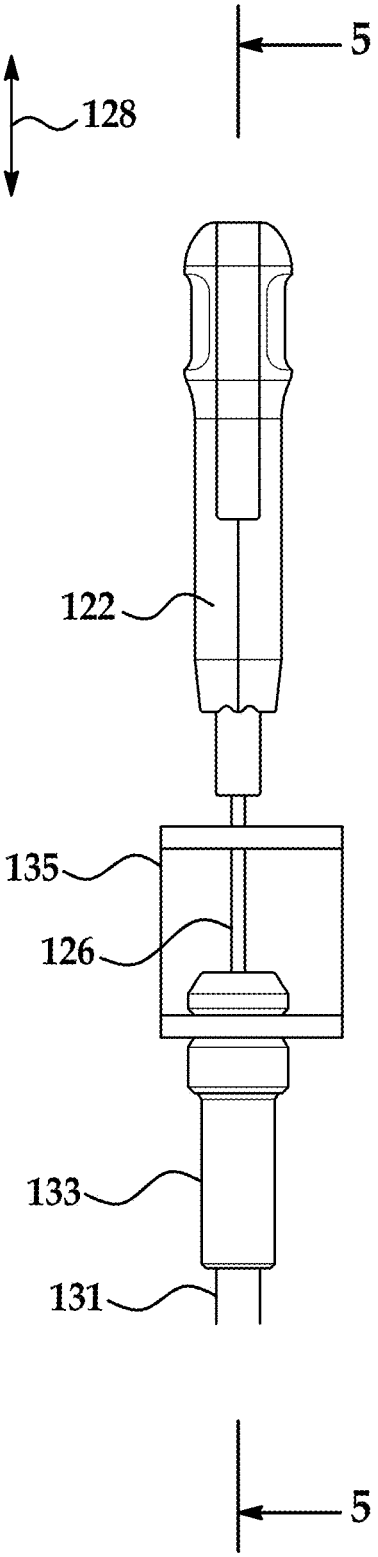
FIG. 4 is a view of a sill button interface for use with the FIG. 4 embodiment.
Figure 5:
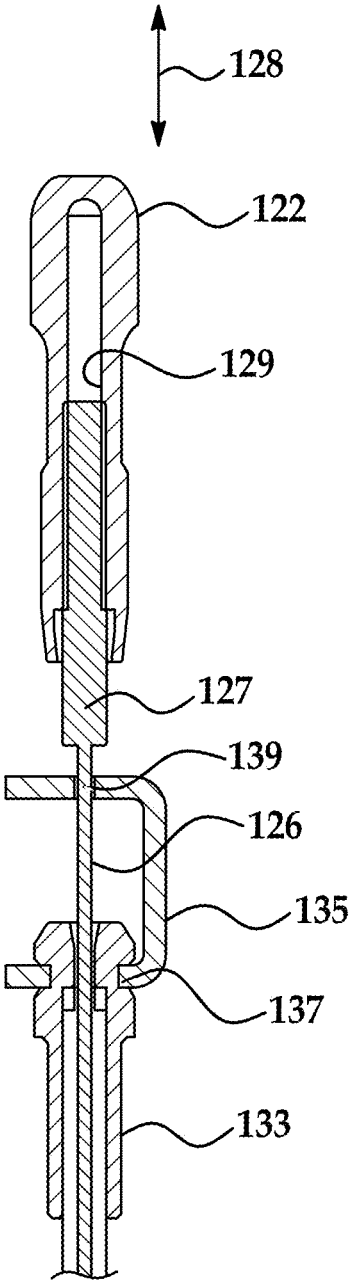
FIG. 5 is a view along lines 5-5 of FIG. 4.

In this embodiment, the sill button or sill knob 122 is directly secured to the sill cable 126 such that a rigid sill rod is no longer required. Referring now to FIGS. 4 and 5, the securement of the sill knob or sill button 122 to the sill cable 126 is illustrated. Here, a threaded rod end 127 is crimped onto an end of the sill cable 126. The sill knob 122 has an internal cavity 129 that is configured to have complementary threads which threateningly engage the threads of the threaded rod 127. Alternatively, the sill knob or sill button 122 may be secured to rod 127 in any known manner. Similarly, rod 127 may be secured to the cable 126 in any known manner. Once the sill button or sill knob 122 is secured to the rod 127, movement of the sill button or sill knob 122 in the direction of arrows 128 will cause a corresponding movement of the sill cable 126 in the directions of arrows 128. Also shown is that the sill cable 126 is slidably received within a sill cable sheath 131 having a cable end fitting 133 secured to a cable mounting bracket 135. In one embodiment, cable mounting bracket 135 may be configured to have a "C" shape.

The cable mounting bracket 135 is mounted in close proximity to the sill button 122 by any suitable fastening means and has a first opening 137 configured to receive the cable end fitting 133 therein and a second opening 139 configured to allow the sill cable 126 to pass therethrough. Accordingly, the cable mounting bracket 135 allows the end of the sill cable 126 proximate to the threaded rod 127 to be secured to a component of the vehicle (e.g., door) proximate to the desired location of sill button 122. In addition, the securement of the cable end fitting 133 and thus cable sheath 131 to mounting bracket 135 allows the movement of the sill button 122 to be transitioned to sill cable 126 and ultimately latch 112. In addition, an opposite end of the cable sheath 131 will have a cable end fitting 141 that is secured to the latch 112 wherein the opposite end of the sill cable 126 is secured to the component or lever of the latch 112 that is required to be moved as the sill button 122 is moved in the directions of arrows 128. In one embodiment, the cable end fitting 141 may be similar to the cable end fitting(s) disclosed in the following Indian Patent Application Ser. No. 583/DEL/2012, filed on Mar. 1, 2012, the contents of which are incorporated herein by reference thereto.

As described above, the incorporation of a threaded rod 127 onto the end of sill cable 126 allows the system 110 to eliminate the need for an elongated sill rod 26 illustrated in at least FIG. 1. This allows the system 110 to have added flexibility in that the sill cable 126 and its cable sheath 131 can be manipulated into multiple configurations in order to allow for the system 110 to accommodate various vehicle door designs it may be installed in.

Figure 6:
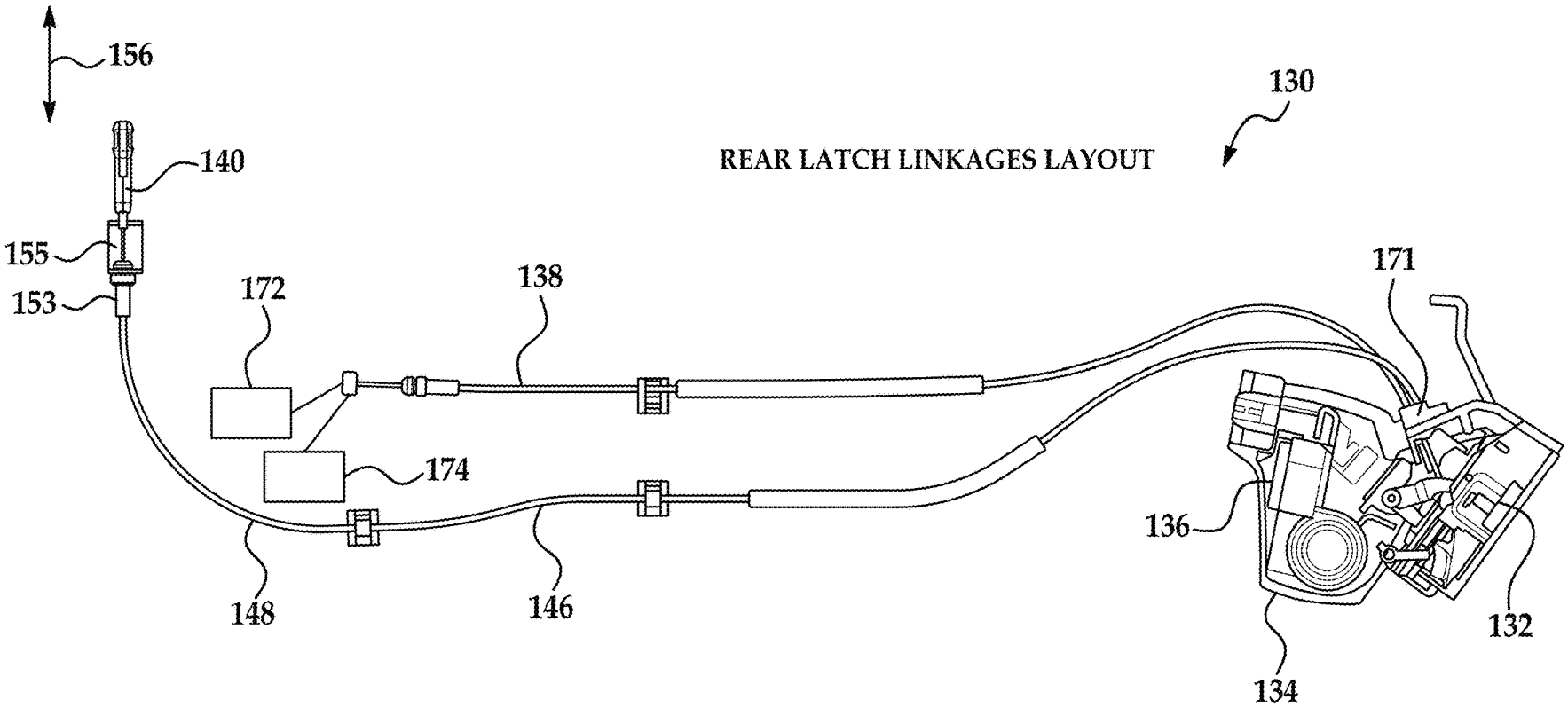
FIG. 6 is a view of a rear door vehicle latch linkage system in accordance with an embodiment of the present invention.

Referring now to FIG. 6, a rear door vehicle latch linkage system 130 is illustrated in accordance with one embodiment of the present invention. Here a rear latch 132 is configured to releasably secure and release a striker (not shown) of the vehicle. Similar to the latch 112 of the front door system 110, the latch 132 may also comprise an actuator 134 with a motor 136 that is configured to manipulate components of the latch 132 in accordance with known technologies. Also shown is that system 130 may also comprise a release cable 138 that is configured to manipulate a detent lever or claw and/or a fork bolt or claw of the latch 132 such that operation of the release cable causes the latch 132 to transition from a latched state to an open state. For example, release cable 138 may be operably coupled to an inside release lever 172 or an outside release lever 174 (each being illustrated schematically by boxes in FIG. 6), which when manipulated by an operator or passenger or system of the vehicle moves cable 138 and ultimately a component of the latch 132. Similar to the system 110, a sill button or sill knob 140 is operatively coupled to a lever of the latch via a single sill cable 146 that is slidably received within a cable sheath 148.

Accordingly and as sill button 140 is moved upwardly and downwardly in the direction of arrows 156, the sill cable 146 manipulates a lever of the latch such that the latch 132 transitions between a locked and unlocked state due to the movement of sill button 140 in the direction of arrows 156.

In this embodiment, the sill button or sill knob 140 is directly secured to the sill cable 146 such that a crank or bell crank lever (illustrated in FIGS. 2A and 2B) is no longer required. As mentioned above, this makes system 130 more flexible to various packaging requirements as the sill cable 146 and its cable sheath 148 can be manipulated around other components as it traverses from the sill button 140 to the latch 132. Moreover, the elimination of the crank or bell crank lever reduces the potential for stroke loss and/or higher force loads on the sill button or knob 140 in order to move the same in the direction of arrows 156.

Figure 7:
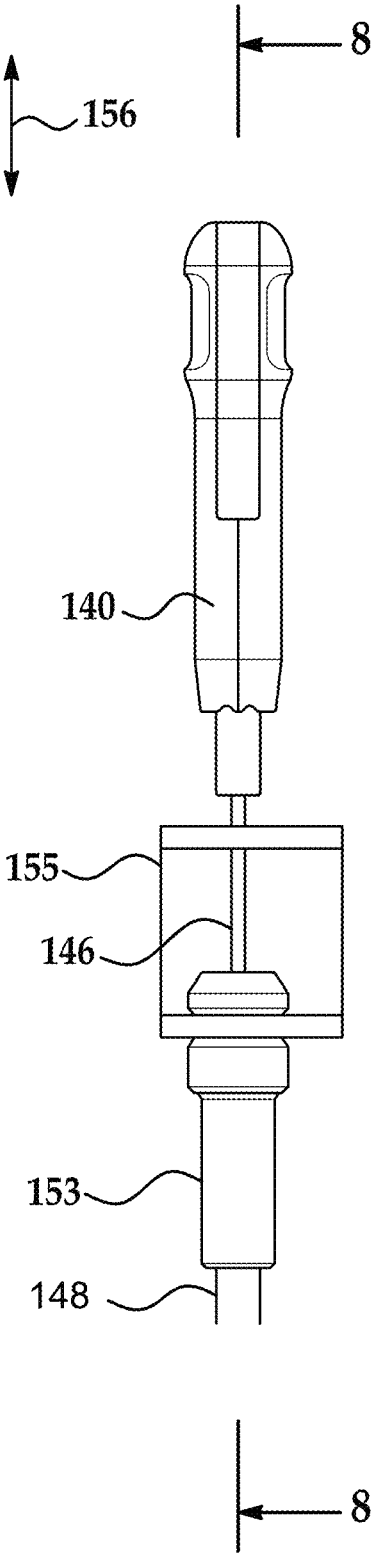
FIG. 7 is a view of a sill button interface for use with the FIG. 6 embodiment.
Figure 8:
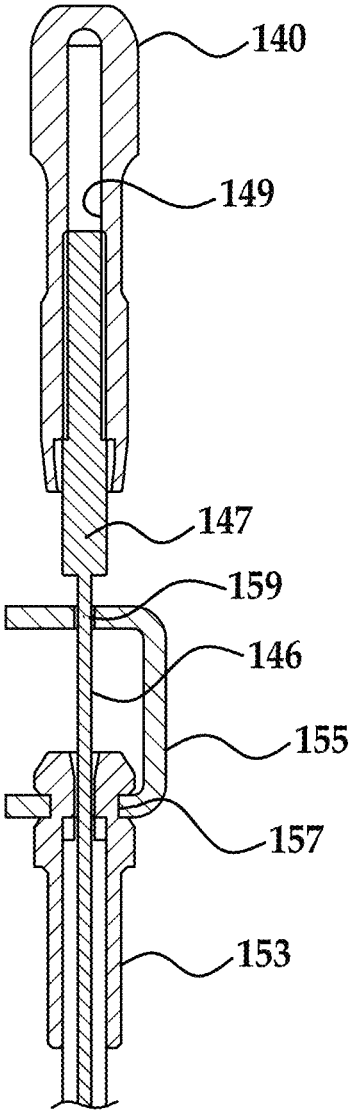
FIG. 8 is a view along lines 8-8 of FIG. 7.

Referring now to FIGS. 7 and 8, the securement of the sill knob or sill button 140 to the sill cable 146 is illustrated. Here, a threaded rod end 147 is crimped onto an end of the sill cable 146. The sill knob 140 has an internal cavity 149 that is configured to have complementary threads which threateningly engage the threads of the threaded rod 147. Alternatively, the sill knob or sill button 140 may be secured to be rod 147 in any known manner. Similarly, rod 147 may be secured to the cable in any known manner. Once the sill button or sill knob 140 is secured to the rod 147, movement of the sill button or sill knob 140 in the direction of arrows 156 will cause a corresponding movement of the sill cable 146 in the directions of arrows 156. Also shown is that the sill cable 146 is slidably received within a sill cable sheath 148 having a cable end fitting 153 secured to a cable mounting bracket 155. In one embodiment, cable mounting bracket 155 may have a "C" shape.

The cable mounting bracket 155 is mounted in close proximity to the sill button 140 by any suitable securement or mounting means and has a first opening 157 configured to receive the cable end fitting 153 therein and a second opening 159 configured to allow the sill cable 146 to pass therethrough. Accordingly, the cable mounting bracket 155 allows the end of the sill cable 146 proximate to the threaded rod 147 to be secured to a component of the vehicle (e.g., door) proximate to the desired location of sill button 140. In addition, the securement of the cable end fitting 153 and thus cable sheath 148 to cable mounting bracket 155 allows the movement of the sill button 140 to be transitioned to the sill cable 146 and ultimately latch 132. In addition, an opposite end of the cable sheath 148 will also have a cable end fitting 171 that is secured to the latch 132 wherein the opposite end of the sill cable 146 is secured to the component or lever of the latch 132 that is required to be moved as the sill button 140 is moved in the direction of arrows 156. In one embodiment, the cable end fitting 171 may be similar to the cable end fitting(s) disclosed in the following Indian Patent Application Ser. No. 583/DEL/2012, filed on Mar. 1, 2012, the contents of which are incorporated herein by reference thereto.

As described above, the incorporation of a threaded rod 147 onto the end of sill cable 146 allows the system 130 to eliminate the bell crank or bell crank lever illustrated in at least FIGS. 2 and 2A. Moreover, the system 130 also eliminates the need for a rigid sill rod also illustrated in at least FIGS. 2 and 2A. These improvements allow system 130 to have added flexibility in that the sill cable 146 and its cable sheath 148 may be manipulated into multiple configurations by bending it into multiple configurations in order to allow for the system 130 to accommodate various vehicle door designs it may be installed. Moreover, the elimination of the bell crank or bell crank lever and the rigid sill rod eliminate the potential for stroke loss and/or higher application forces in order to manipulate the latch between the locked and unlocked states through the movement of the sill button or sill knob 140. Still further, the elimination of additional mechanical components will also reduce the cost of the system.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A linkage system for vehicle door latch, comprising:

a sill button;

a latch;

a cable operatively coupled to the latch and the sill button; and a sill button interface directly secured to an end of the cable at one end and directly secured the sill button at another end, wherein the cable extends directly from the sill button interface to the latch, wherein the cable extends from the sill button interface to a cable mounting bracket adjacent to the sill button, wherein the cable is slidably received within a cable sheath secured to the latch at one end and the cable mounting bracket at an opposite end, and wherein the cable sheath is mounted to the latch with a first cable end fitting and wherein the cable sheath is mounted to the cable mounting bracket with a second cable end fitting.

2. The linkage system as in claim 1, wherein the sill button interface is a threaded rod crimped onto the cable at the one end and threadingly received in an opening of the sill button at the another end.

3. The linkage system as in claim 1, wherein the cable sheath has a first opening configured to receive the second cable end fitting therein and a second opening configured to allow the cable to pass therethrough.

4. The linkage system as in claim 1, wherein the sill button interface is a threaded rod crimped onto the cable at the one end and threadingly received in an opening of the sill button at the another end.

5. The linkage system as in claim 4, wherein the system is configured for use as a front door vehicle latch linkage system.

6. The linkage system as in claim 4, wherein the system is configured for use as a rear door vehicle latch linkage system.

7. The linkage system as in claim 4, wherein the system further comprises an actuator.

8. The linkage system as in claim 1, wherein the system further comprises a release cable to manipulate the latch so that a striker releasably retained by the latch is released therefrom due to manipulation of the release cable.

9. The linkage system as in claim 4, wherein the sill button is operatively coupled to a lever of the latch via the cable.

10. The linkage system as in claim 4, wherein no rigid sill rod is used in the system.

11. The linkage system as in claim 4, wherein the cable and the cable sheath are flexible.

12. The linkage system as in claim 1, wherein the cable mounting bracket is "C" shaped and wherein the sill button is located on an interior surface of a vehicle door.

13. A vehicle door latch, comprising:

a sill button;

a latch;

a cable operatively coupled to the latch and the sill button; and a sill button interface directly secured to an end of the cable at one end and directly secured to the sill button at another end, wherein the cable extends directly from the sill button interface to the latch, wherein the cable extends from the sill button interface to a cable mounting bracket adjacent to the sill button, wherein the cable is slidably received within a cable sheath secured to the latch at one end and the cable mounting bracket at an opposite end, and wherein the cable sheath is mounted to the latch with a first cable end fitting and wherein the cable sheath is mounted to the cable mounting bracket with a second cable end fitting.

14. The vehicle door latch as in claim 13, wherein the cable sheath has a first opening configured to receive the second cable end fitting therein and a second opening configured to allow the cable to pass therethrough.

15. A method of operatively coupling a sill button to a vehicle latch, the method comprising:

securing a first end of a cable to the sill button with a sill button interface;

securing a second end of the cable to the latch; and wherein the cable extends directly from the sill button interface to the latch, wherein the cable extends from the sill button interface to a cable mounting bracket adjacent to the sill button, wherein the cable is slidably received within a cable sheath secured to the latch at one end and the cable mounting bracket at an opposite end, and wherein the cable sheath is mounted to the latch with a first cable end fitting and wherein the cable sheath is mounted to the cable mounting bracket with a second cable end fitting.

16. The method as in claim 15, wherein the cable sheath has a first opening configured to receive the second cable end fitting therein and a second opening configured to allow the sill cable to pass therethrough.

17. The linkage system as in claim 1, wherein the linkage system transfers movement of the sill button to the latch with only a single cable.

18. The vehicle door latch as in claim 13, wherein movement of the sill button is transferred to the latch with only a single cable.

19. The method as in claim 15, wherein movement of the sill button is transferred to the latch with only a single cable.

* * * * *